US008752456B1

(12) United States Patent
Turnbo

(10) Patent No.: US 8,752,456 B1
(45) Date of Patent: Jun. 17, 2014

(54) DEVICE FOR DEPLOYMENT OF ALTERNATE TOOL HEADS

(76) Inventor: William Andrew Turnbo, Newbern, TN (US)

( * ) Notice: Subject to any disclaimer, the term of this patent is extended or adjusted under 35 U.S.C. 154(b) by 403 days.

(21) Appl. No.: 13/135,423

(22) Filed: Jul. 5, 2011

(51) Int. Cl.
*B25B 23/00* (2006.01)

(52) U.S. Cl.
USPC ..... 81/439; 81/44; 7/138; 408/238

(58) Field of Classification Search
USPC ..... 81/436–461
See application file for complete search history.

(56) References Cited

U.S. PATENT DOCUMENTS

| | | | | |
|---|---|---|---|---|
| 138,528 | A | 11/1872 | Reed et al. | |
| 814,020 | A | 5/1905 | Clifford | |
| 1,323,056 | A * | 11/1919 | Hofmann | 7/138 |
| 2,632,489 | A | 2/1952 | Johnson | |
| 2,730,145 | A | 1/1956 | Brown | |
| 3,034,550 | A | 5/1962 | Dahl | |
| 3,216,288 | A | 11/1965 | Gardner | |
| 4,070,932 | A * | 1/1978 | Jeannotte | 81/177.2 |
| 4,954,025 | A * | 9/1990 | Crawford et al. | 408/238 |
| 5,711,043 | A * | 1/1998 | Crawford et al. | 7/165 |
| 5,964,132 | A | 10/1999 | Chen | |
| 6,128,978 | A * | 10/2000 | Richey | 81/44 |
| 7,131,357 | B2 * | 11/2006 | Wolf | 81/437 |
| 2011/0038659 | A1 * | 2/2011 | Andochick | 401/48 |

* cited by examiner

*Primary Examiner* — Lee D Wilson
*Assistant Examiner* — Melanie Alexander

(57) ABSTRACT

Device for deployment of alternate tool heads having a tool bar, bias element, tool bar case, tool bar case removable cap, and tool bar locking pin.

6 Claims, 3 Drawing Sheets

DEVICE FOR DEPLOYMENT OF ALTERNATE TOOL HEADS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of mechanical arts and more specifically to device for deployment of alternate tool heads.

For the completion of many tasks, it is often necessary to employ different tools and to constantly switch from one to another. In example, sundry arts require the use of screws having threads which engage elements to be joined by means of holes or bores having corresponding threads which will draw said elements together as the screw is rotated and hold them fast.

Said screws are generally rotated by means of a tool, screwdriver, which engages a screw head, bolt head, or other twisting device. However, the tool engagement points of all such devices are not uniform. Thus, a variety of different tools is required if an artisan, carpenter, mechanic, etc., is to be prepared to work with all types of screws, bolts and other twisting devices.

The most popular screw head configurations comprise the standard head which has a straight slot into which the corresponding straight edge of a screwdriver may be inserted and the Phillips head which comprises two perpendicular slots which taper to comprise an indention in the screw head into which the four tapering splines of the Phillips screwdriver may be inserted.

Because an artisan is likely to encounter both types on any given job or project, he must carry both type screwdrivers, and he must constantly pick up one type, lay it down, and pick up another type as variety of screw heads requires. This can be inconvenient, frustrating, and time consuming. It can also give occasion to loss or misplacement of a tool. Therefore tools which have readily changeable heads have been contrived. The instant invention is a needed advancement of this art.

BRIEF SUMMARY OF THE INVENTION

The primary object of the invention is convenience of not having to carry more than one tool.

Another object of the device is a tool with rapidly and easily changeable heads.

Still another object of the device is a compact unit for carrying or storage having tool heads concealed.

Yet another object of the invention is simplicity of manufacture with maximum economy of labor and material.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Device for deployment of alternate tool heads comprising: tool bar, bias element, tool bar case, tool bar case removable cap, and tool bar locking pin.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

LIST OF NUMBERED ITEMS DEPICTED

Figure 1:
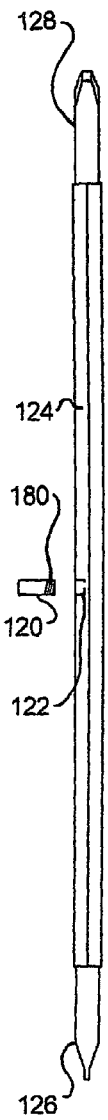
FIG. 1 is a side view of a tool bar and tool bar locking pin.

120 Tool bar locking pin
122 Tool bar locking pin socket
124 Tool bar
126 Standard head
128 Phillips head
130 Bias element
132 Tool bar case
134 Threaded boss
136 Tool bar case central bore
138 Bias element stop shoulder
140 Bias element stop collar
142 Tool bar case removable cap
144 Tool bar locking pin slide channel
146 Tool bar locking pin rotation slot
148 Tool bar locking pin anchor slot
150 Tool bar locking pin seat
152 Bias element central void
154 Tool bar case removable cap bore
158 Toll bar case removable cap threaded bore
160 Tool bar locking pin insertion slot
162 Neutral position

164 Tool bar case removable cap threaded bore face
166 Toll bar case removable end bore
170 Tool bar locking pin tab
173 Tool bar case openable end
174 Tool bar case fixed end
176 Tool bar case removable cap anterior
178 Tool bar case removable cap posterior
180 Tool bar locking pin contour configuration

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

FIG. 1 shows a tool bar (124) having different tool heads at opposing ends. In this instance, at one end is a flat head screwdriver head (126), while at the opposite end is a Phillips screwdriver head (128). Also shown are a tool bar locking pin (120) and a tool bar locking pin socket (122).

Figure 1A:
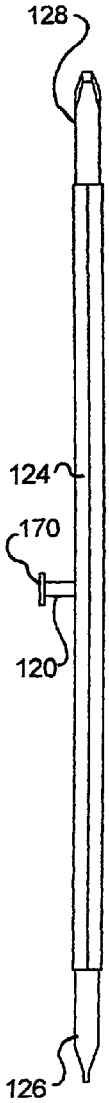
FIG. 1A is a side view of a tool bar with tool bar locking pin attached.

FIG. 1 and FIG. 1A also show that the tool bar locking pin (120) is removably attachable to the tool bar (124). In example, the tool bar locking pin (120) may have threads (180) which removably engage the tool bar locking pin socket (122). However, embodiments of the instant art wherein the tool bar locking pin (120) is permanently attached to the tool bar (124) or wherein the tool bar locking pin (120) is an integral part of the tool bar (124), or an analogous structure comprising the tool bar (124) are contemplated.

Figure 2:
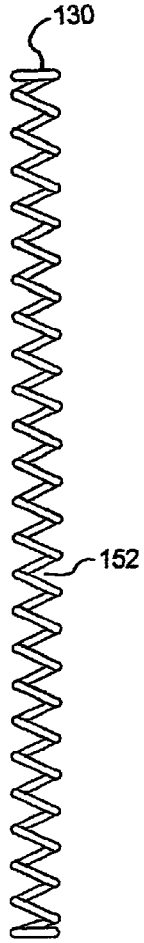
FIG. 2 is a side view of a bias element.
Figure 2A:
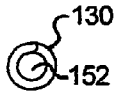
FIG. 2A is a front view of a bias element

FIG. 2 and FIG. 2A show a bias element (130) having a substantially uniform diameter and a central void (152).

Figure 3:
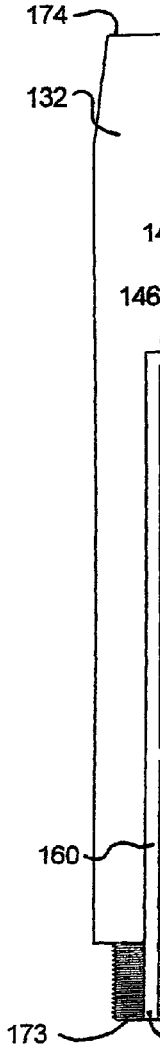
FIG. 3 is a side view of a tool bar case.
Figure 3A:
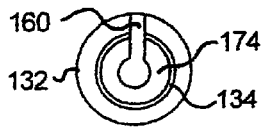
FIG. 3A is a front view of a tool bar case.

FIG. 3 and FIG. 3A show a tool bar case (132) having opposing ends, one being a fixed end (174) and the other an open end (173). The open end (173) comprises a threaded boss (134). Also seen are a tool bar locking pin slide channel (144), tool bar locking pin rotation slots (146), tool bar locking pin anchor slots (148) and tool bar locking pin seats (150). The tool bar locking pin slide channel (144) extends towards opposing ends of the tool bar case (132). One end (174) is fixed, having an aperture or bore (166) of minimum diameter necessary to allow passage of the tool bar (124) there through. The other end (173) is open. It comprises a tool bar case central bore (136) having a diameter minimum necessary to allow passage of the bias element (130) there through.

The tool bar locking pin rotation slots (146) extend away from the tool bar locking pin slide channel (144), one at a point proximal the tool bar case fixed end (174) and another at a point proximal the open opposing tool bar case end (173), said end (173) comprising the threaded boss (134).

The tool bar locking pin anchor slots (148) comprise tool bar locking pin seats (150) opposite the intersection of the tool bar locking pin anchor slots (148) and the tool bar locking pin rotation slots (146). Also shown in FIG. 3 and FIG. 3A is a tool bar locking pin insertion slot (160) extending from the opposing end (173) comprising the threaded boss (134), through said threaded boss (134) to the tool bar locking pin slide channel (144).

Figure 4:
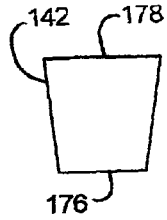
FIG. 4 is a side view of a tool bar case removable cap.
Figure 4A:
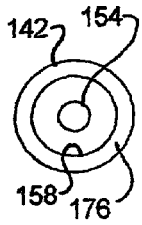
FIG. 4A is a rear view of a tool bar case removable cap.
Figure 4B:
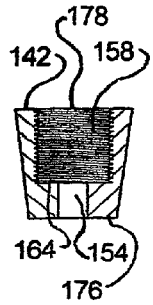
FIG. 4B is a side cross sectional view of a tool bar case removable cap.

FIG. 4, FIG. 4A, and FIG. 4B show a tool bar case removable cap (142) having an anterior (176) and a posterior (178) and also having a removable tool bar case removable cap threaded bore (158) extending from the posterior to a tool bar case removable cap threaded bore face (164). Extending, substantially coaxially from the tool bar case removable cap threaded bore (158), from the anterior (176) to the tool bar case removable cap threaded bore face (164) is depicted a tool bar case removable cap bore (154).

Figure 6:
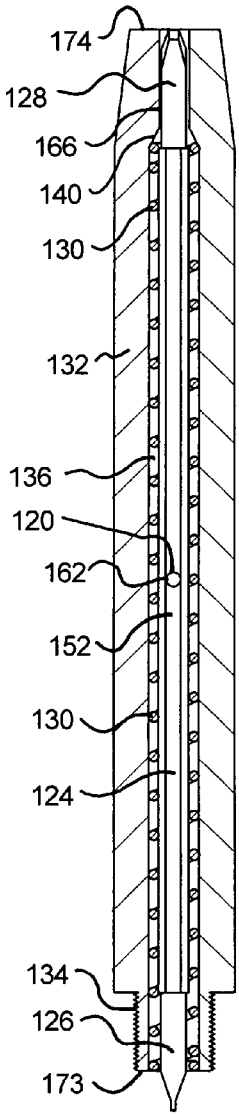
FIG. 6 is a side cross sectional view of the device for deployment of alternate tool heads with removable cap not attached.
Figure 7:
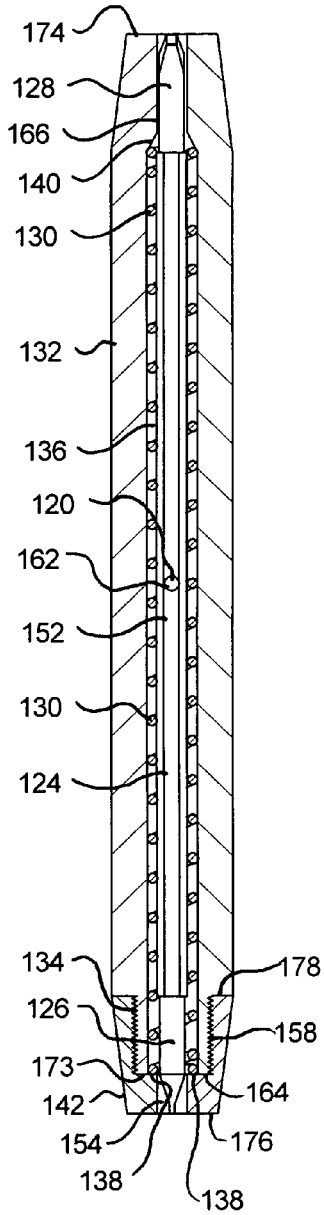
FIG. 7 is a side cross sectional view of the device for deployment of alternate tool heads with removable cap attached.

FIG. 6 and FIG. 7 show the tool bar (124) inserted through the bias element central void (152). The diameter of the bias element central void (152) relative the diameter of the tool bar (124) is such that the tool bar will fit through said central void (152) with sufficient clearance that the tool bar may rotate within the bias element central void (152) and the bias element (130) may move relative the tool bar (124). Said clearance ideally is the minimum necessary to allow said insertion of the tool bar (124), said rotation and said relative movement, but said clearance may be greater.

Noted also is that after the toolbar (124) is inserted through the bias element central void (152), the tool bar locking pin (120) may be affixed to the tool bar (124) so that the tool bar locking pin (120) extends through the bias element (130) in such a way that function of the bias element (130) is not compromised. In example, if the bias element (130) is a spring, the tool bar locking pin (120) would extend between a gap in its coils, as in FIG. 2B. Alternatively, the locking pin (120) may be permanently affixed to the tool bar (124) and the bias element (130), if a coil spring, slid onto the tool bar (124) from either end (126, 128) and twisted past the locking pin (120).

Also seen in FIG. 6 and FIG. 7 is a tool bar case central bore (136) extending, substantially coaxially with the tool bar case (132), from the tool bar case openable end (173) comprising the threaded boss (134) through the tool bar case (132) to a point proximal the tool bar case fixed end (174). A tool bar case end bore (166) extends from said tool bar case fixed end (174) opposite the threaded boss (134) to the tool bar case central bore (136), substantially coaxially with the tool bar case (132). The tool bar case end bore (166) is of smaller diameter than the tool bar case central bore (136). Thus the transition of said tool bar case central bore (136) to said tool bar case end bore (166) effectively comprises a bias element stop collar (140).

Now, it may be readily appreciated that the tool bar locking pin slide channel (144), tool bar locking pin rotation slots (146), tool bar locking pin anchor slots (148), and the tool bar locking pin insertion slot (160) communicate with the tool bar case central bore (136).

FIG. 6 and FIG. 7 depict that the diameter of the bias element (130) relative the diameter of the tool bar case central bore (136) comprises sufficient clearance for bias element (130) to be inserted into said tool bar case central bore (136). Ideally, said clearance will be the minimum necessary for said bias element (130) insertion. However, said clearance is small enough so that the bias element (124) may encounter the bias element stop collar (140). Thusly, passage of the bias element (130) through the tool bar case (132) is limited by the stop collar (140).

Also noted is that the diameters of the tool bar case end bore (166) and the tool bar case removable cap bore (154) relative the diameter of the tool bar (124) are such that the tool bar (124) may pass through, and rotate within, said tool bar case end bore (166) and the tool bar case removable cap bore (154) with clearance. Ideally, clearance is of the minimum necessary to allow said passage and said rotation.

Also, one skilled in the art will readily appreciate that the tool bar locking pin insertion slot (160) provides means for the tool bar (124) and bias element (130) to be inserted into the tool bar case (132) with the tool bar locking pin (120) previously attached to the tool bar (124). To wit, the tool bar locking pin (120) passes through the tool bar locking pin insertion slot (160) as the bias element and tool bar are passed into the tool bar case central bore (136).

Figure 5:
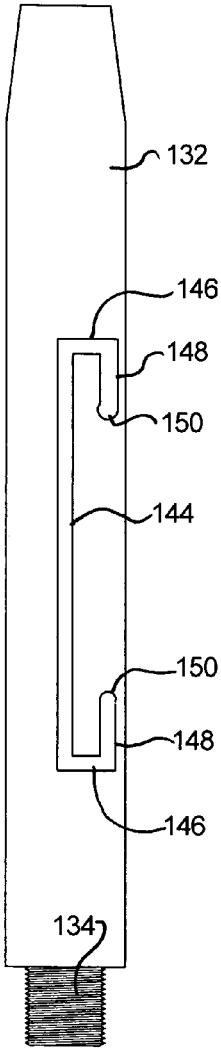
FIG. 5 is a side view of a tool bar case.

Additionally, it may be appreciated that the tool bar locking pin (120) may be attached to the tool bar (124) after the bias element (130) with tool bar (124) in the bias element central void (154) is inserted into the tool bar case central bore (136) by aligning the tool bar locking pin socket (122) with the tool bar locking pin slide channel (144) and inserting the tool bar locking pin (120) through said slide channel (144) and through the bias element (130), as in FIG. 2B, to engage the tool bar locking pin socket (122). In this case, the tool bar locking pin insertion slot (160) may be eliminated as in FIGS. 5 and 5A.

FIG. 2C shows that the instant art may comprise two bias elements (130) each having a central void (154). Thus, it may be understood that one bias element may be inserted into the tool bar case (132) and the tool bar (124) then inserted into the tool bar case (132) through the tool bar case central void (154) whereupon the tool bar locking pin (120) will communicate with said bias element (130). The other bias element (130) may be passed over the tool bar (124), or the tool bar (124) may have been inserted through said other bias element central void (154) prior to insertion into the tool bar case (132), to communicate with the opposite side of the tool bar locking pin (120). Therefore, it may be readily appreciated that the tool bar locking pin (130) may then be permanently attached to the tool bar (124), an integral part of the tool bar (124), or an analogous structure comprising the tool bar (124).

The tool bar case removable cap (142) is removably attached to the tool bar case (132). In example, FIG. 7 shows that the tool bar case removable cap (142) may communicate with the tool bar case threaded boss (134) by means of the tool bar case removable cap threaded bore (158) whereupon the openable end of tool bar case (173) comprising the threaded boss (134) and the tool bar case removable cap threaded bore face (164) are substantially contiguous such that the tool bar case central bore (136) and the tool bar case removable cap bore (154) join. The diameter of the tool bar case removable cap bore (154) is smaller than that of the tool bar case central bore (136), thus, the joining of the two parts to, each to the other, creates a bias element stop shoulder (138).

FIG. 7 also shows that the length of the bias element (130) is contrived such that when said bias element (130) is inserted into the tool bar case (132), said bias element is contained therein between the bias element stop collar (140) and the bias element stop shoulder (138). Additionally seen is that, when the tool bar case removable cap (142) and the tool bar case (132) communicate as previously described, the tool bar (124) does not extend past the opposing end (174) and does not extend past the tool bar case removable cap anterior (176). In said tool bar (124) disposition, the tool bar locking pin (120) is positioned in neutral position (162), and it may be appreciated that the bias element (130) is contrived to maintain the tool bar locking pin (120) in said neutral position (162). Ideally, said bias is sufficient to keep the tool bar (124) essentially centered between the extremities (176, 178) of the tool bar case (132) during routine handling of the device thusly preventing unintended exposure of either tool head (126, 128).

Figure 8:
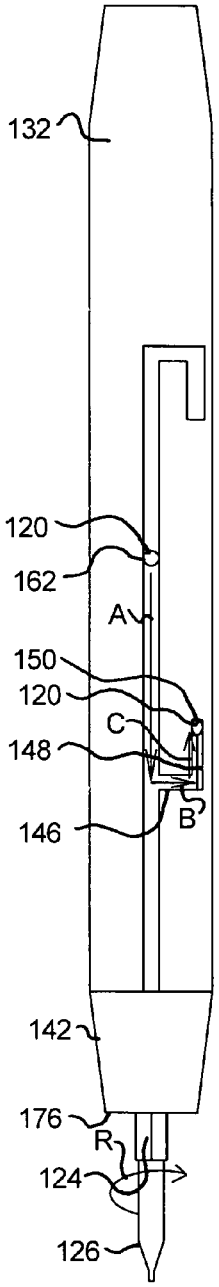
FIG. 8 is a side view of the device for deployment of alternate tool heads.
Figure 8A:
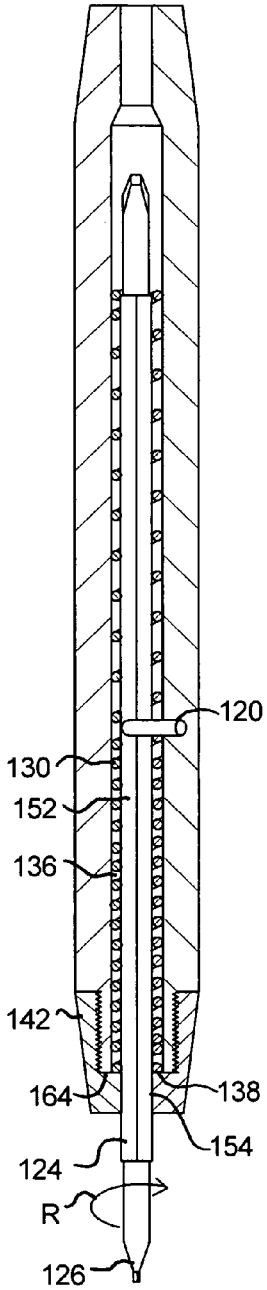
FIG. 8A is a side cross sectional view of the device for deployment of alternate tool heads.

FIG. 8 and FIG. 8A show that when the tool bar locking pin (120) is moved toward the tool bar case removable cap anterior (176), direction A as indicated by arrow, the tool bar locking pin (120) will engage the bias element (130), as may be understood from FIG. 2B, in example if the bias element is a spring, the tool bar locking pin (120) will contact a coil, thusly urging said bias element (130) toward said tool bar case removable cap anterior (176). However, the bias element stop shoulder (138) will prevent movement of the bias element (130) and cause the bias element (130) to compress.

When the tool bar locking pin (120) is positioned proximal the tool bar locking pin rotation slot (146) the tool bar locking pin may be moved substantially perpendicularly, direction B as indicated by arrow, toward the tool bar locking pin anchor slot (148), thusly rotating the tool bar (124) as indicated by curved arrow R. When the tool bar locking pin (120) is proximal the tool bar locking pin anchor slot (148), the tool bar locking pin (120) may be moved, in direction C as indicated by arrow, either manually by external force, or by the bias element (130), through said slot (148) to contact the tool bar locking pin seat (150), whereupon said bias element (130) will tend to maintain the tool bar locking pin (120) against the tool bar locking pin seat (150).

As the tool bar locking pin (120) is moved toward the tool bar case removable cap anterior (176), the tool bar (124) is moved so as to expose the flat head (126) to such extent that said flat head (126) may be functionally employed. Additionally, it may be readily appreciated that as pressure is exerted on a work piece by engagement of the tool head (126) in direction C, the tool bar will be held fixedly by the tool bar locking pin seat (150). Also, as rotational force is applied to a work piece by the tool head (126) counter rotational movement of the tool bar (124) will be prevented by contact of the tool bar locking pin with the tool bar locking pin anchor slot (148) walls.

Also readily appreciated is that the tool bar locking pin (120) may be moved opposite direction C to the tool bar locking pin rotation slot (146) and moved opposite direction B, as indicated by arrow, to the tool bar locking pin slide channel (144) whereupon the bias element will return the tool bar locking pin to neutral position (162) thereby withdrawing the tool head (126) past the tool bar case removable cap anterior (176).

Figure 9:
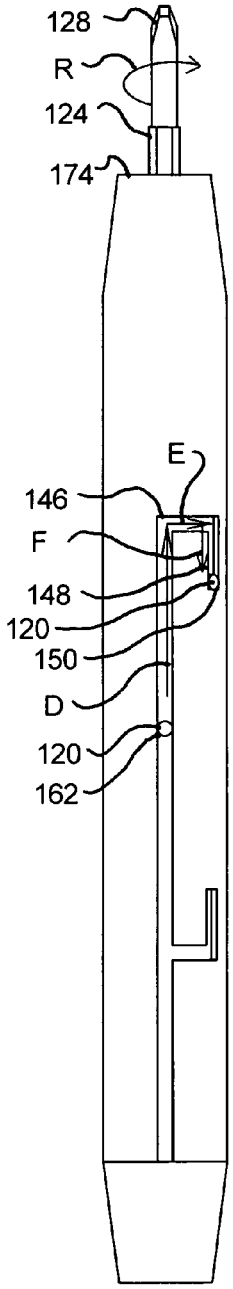
FIG. 9 is a side view of the device for deployment of alternate tool heads.
Figure 9A:
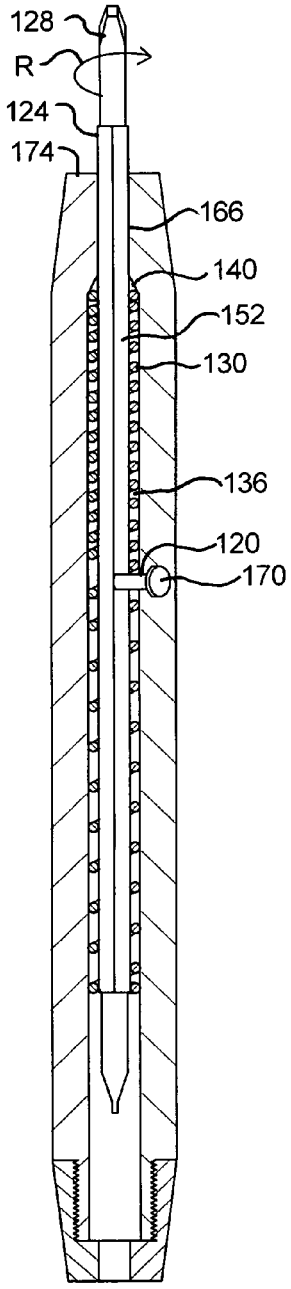
FIG. 9A is a side cross sectional view of the device for deployment of alternate tool heads.

FIGS. 9 and 9A show that that the tool bar locking pin (120) may be moved from neutral position toward the tool bar case end (174) opposite the threaded boss (134), direction D as indicated by arrow, whereupon the tool bar locking pin (120) will engage the bias element (130). In example if the bias element (130) is a spring, the tool bar locking pin (120) will contact a coil, thusly urging said bias element (130) toward the tool bar case end (174) opposite the threaded boss (134). However, the bias element stop collar (140) will prevent movement of the bias element (130) and cause the bias element (130) to compress.

When the tool bar locking pin (120) is positioned proximal the tool bar locking pin rotation slot (146) the tool bar locking pin (120) may be moved substantially perpendicularly, direction E as indicated by arrow, toward the tool bar locking pin anchor slot (148), thusly rotating the tool bar (124) as indicated by curved arrow, R. When the tool bar locking pin (120) is proximal the tool bar locking pin anchor slot (148), the tool bar locking pin (120) may be moved, in direction F as indicated by arrow, either by manually exerted force, or by the bias element (130), through said slot (148) to contact the tool bar locking pin seat (150), whereupon said bias element (130) will tend to maintain the tool bar locking pin (120) against the tool bar locking pin seat (150).

As the tool bar locking pin (120) is moved toward the tool bar case end (174) opposite the threaded boss (134), the tool bar (124) is moved so as to expose the Phillips head (128) to such extent that said Phillips head (128) may be functionally employed. Additionally, it may be readily appreciated that as pressure is exerted on the tool bar case (132) by engagement of the tool head (128) in direction F, movement of the tool bar will be prevented by the tool bar locking pin seat (150). Also, as rotational force is applied to a work piece by the tool head (126) counter rotational movement of the tool bar (124) will be prevented by contact of the tool bar locking pin with the tool bar locking pin anchor slot (148) walls.

Also readily appreciated is that the tool bar locking pin (120) may be moved opposite direction D to the tool bar locking pin rotation slot (146) and moved opposite direction E, as indicated by arrow, to the tool bar locking pin slide channel (144) whereupon the bias element will return the tool bar locking pin to neutral position (162) thereby withdrawing the tool head (126) past the tool bar case end (174) opposite the threaded boss (134).

It may be easily understood that for the tool bar locking pin (120) to be manually manipulated, the tool bar locking pin (120) must extend sufficient distance from the tool bar (124) through the tool bar locking pin slide channel (144) to provide access by the user. Ideally, said extension will be the minimum necessary for this purpose. For convenience, movement of the tool bar locking pin (120) may be facilitated by the addition of a tool bar locking pin tab (170) as seen in FIG. 1A.

Now, one skilled in the art will readily appreciate that when the tool bar locking pin (120) is in neutral position (162), both tool heads (126, 128) are entirely enclosed within the tool bar case (132). This allows the instant art to be safely stored or carried in a minimum space and with no protruding, sharp elements which could snag material or cause injury. Also, the instant art may be quickly and easily converted from one tool (126) to another (128). In addition, though the instant art is described as comprising a flat head screwdriver and a Phillips head screwdriver, the instant art is not thusly limited but may comprise any number of other tool combinations, in example combinations comprising sockets, cutters, wrenches, punches, etc.

Figure 5B:
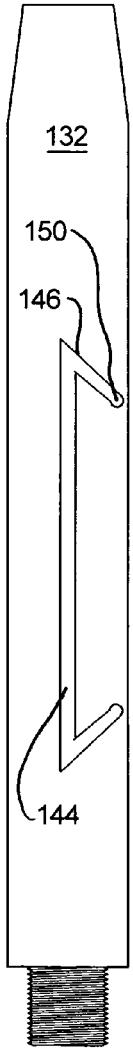
FIG. 5B is a front view of a tool bar case.
Figure 5A:
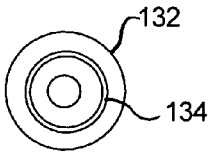
FIG. 5A is a front view of a tool bar case.

FIG. 5B shows that in an alternate embodiment of the tool bar case (132), the tool bar locking pin rotation (146) slot may be disposed such that the tool bar locking pin anchor slot (148) may be eliminated. Also, the tool bar locking pin rotation slot (146) may comprise the tool bar locking pin anchor seat (150). Additionally, it is additionally shown that the tool bar locking pin anchor seat (150) may comprise configuration (180) to conform to the tool bar locking pin (120).

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device capable of deploying alternate tool heads comprising a:

a tool bar comprising tool heads with one tool head on a first end and a second tool head on a second end;

a bias element comprising one or more coil springs;

a tool bar case comprising a central bore and two end bores;

a tool bar locking pin slide channel extending toward opposing extremities ends of the tool bar case, and one or more tool bar locking pin rotation channels intersecting one more locking pin slide channels extending away from the tool bar locking pin slide channel, one or more tool bar locking pin anchor channels intersecting one or more tool bar locking pin rotation channels;

a tool bar case cap having one or more bores, said tool bar case cap removably attachable to the tool bar case; and the tool bar further comprising a tool bar locking pin extending from to the tool bar locking pin slide channel, so configured that the tool bar locking pin communicates with the bias element, and so configured that the tool bar can assume an orientation relative the tool bar case such that said tool bar and said tool heads are entirely contained within said tool bar case and cap.

2. The device according to claim 1, wherein the tool bar cap comprises one or more bores.

3. The device according to claim 1, wherein the tool heads are different from each other.

4. The device according to claim 1, wherein the first tool head is a phillips head and the second tool head is a flat head are different from each other.

5. The device according to claim 1, wherein the tool bar case cap is threadably attachable from the tool bar case.

6. The device according to claim 1, wherein the tool bar further comprises a tool bar locking pin socket disposed between the first and second tool heads, and the tool bar locking pin is removable attachable to the tool bar locking pin socket.

* * * * *